United States Patent [19]

Mitamura

[11] 4,085,542

[45] Apr. 25, 1978

[54] SONIC RESPONSIVE TOY VEHICLE STEERING SYSTEM

[75] Inventor: Isao Mitamura, Tokyo, Japan

[73] Assignee: Tomy Kogyo Co., Inc., Tokyo, Japan

[21] Appl. No.: 755,863

[22] Filed: Dec. 30, 1976

[30] Foreign Application Priority Data

Jul. 30, 1976 Japan ..... 51-102792[U]

[51] Int. Cl.[2] ..... A63H 29/22

[52] U.S. Cl. ..... 46/256; 46/262

[58] Field of Search ..... 46/256, 262

[56] References Cited

U.S. PATENT DOCUMENTS

| | | | |
|---|---|---|---|
| 3,142,132 | 7/1964 | Johnson | 46/256 |
| 3,406,481 | 10/1968 | Tachi | 46/256 |
| 3,871,129 | 3/1975 | Tong | 46/262 |

*Primary Examiner*—Louis G. Mancene
*Assistant Examiner*—Robert F. Cutting
*Attorney, Agent, or Firm*—Staas & Halsey

[57] ABSTRACT

The present invention relates to a toy vehicle provided with a chassis, a propulsion and guidance wheel mounted to the chassis for rotation to propel the vehicle along a surface and for turning to steer the vehicle, a propulsion mechanism within the chassis, a system for operatively connecting the wheel and the propulsion mechanism to rotate the wheel to propel the vehicle, a system for sensing predetermined sound waves and temporarily connecting the propulsion mechanism to the wheel to turn the wheel to steer the vehicle, and a handheld sound wave generating unit remote from the vehicle for generating the sound waves.

9 Claims, 8 Drawing Figures

FIG. 5
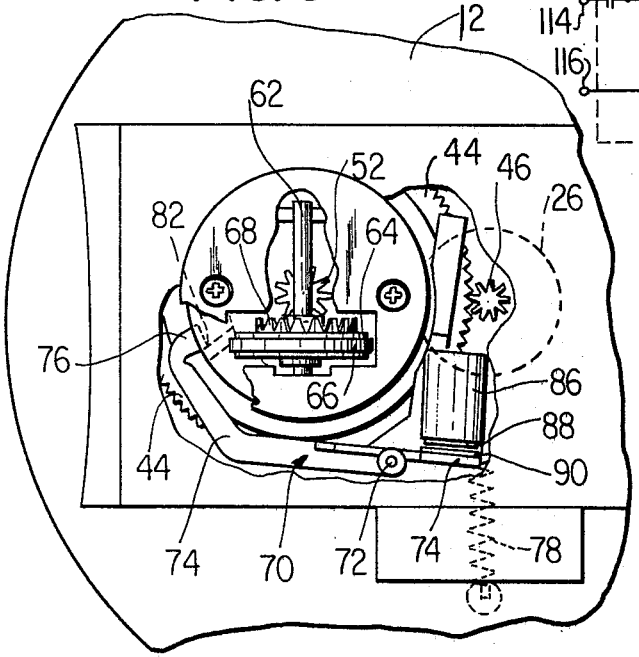
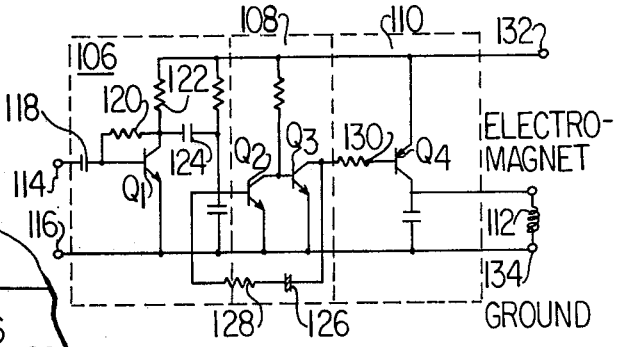
FIG. 8
FIG. 6
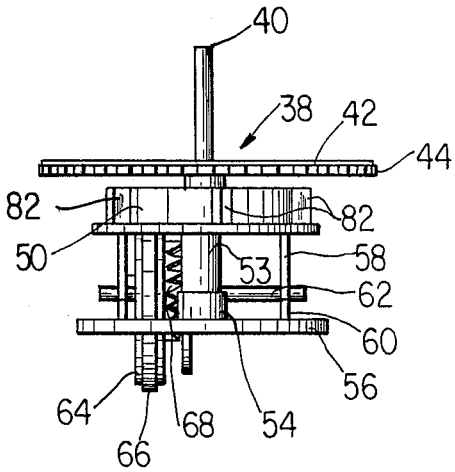
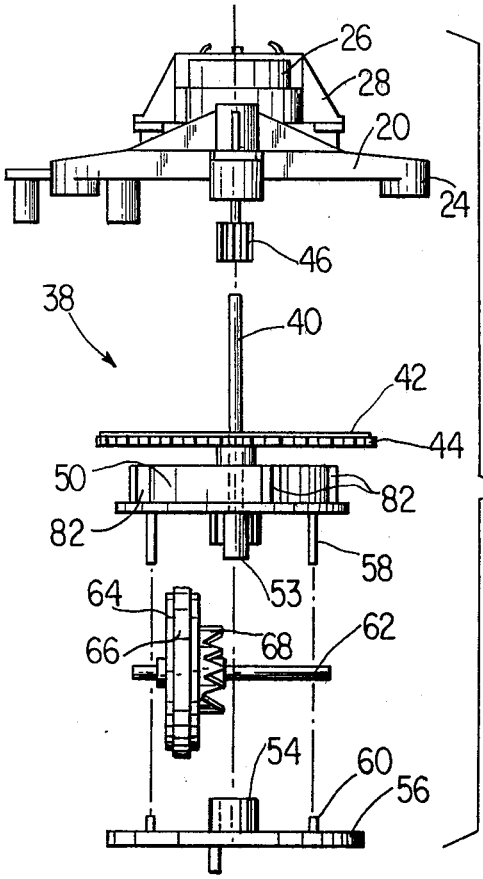
FIG. 7

SONIC RESPONSIVE TOY VEHICLE STEERING SYSTEM

BACKGROUND AND SUMMARY OF THE INVENTION

The present invention relates to the general class of toys wherein the child is permitted to steer a toy vehicle from a remote position. In particular, the present invention utilizes a constant frequency handheld sound wave generating unit to transmit sonic waves to a transducer within the vehicle which is responsible for translating the sound waves into proportional electrical signals which energize an electromagnet which is responsible for actuating a system which rotates the propulsion-guidance wheel to steer the vehicle while the wheel is rotating to propel the vehicle along a surface. Thus, both the propulsion and steering functions are performed by a single wheel which continuously rotates to propel the vehicle and which in response to sensing the sound waves generated by the handheld unit temporarily connects the propulsion system of the toy vehicle to the wheel to turn same to change the direction of travel of the vehicle.

BRIEF DESCRIPTION OF THE DRAWINGS

FIG. 5 is a bottom plan view of the housing to which the propulsion-steering wheel is mounted, illustrating the gearing mechanism for continuously rotating the wheel to propel the vehicle, and the rotatably mounted actuating member;

FIG. 6 is a front elevational view of the combination propulsion-steering wheel and the housing for same;

FIG. 7 is an exploded front elevational view of the components of the combination propulsion-steering wheel and the bracket for suspending same from the vehicle; and FIG. 8 is an electrical diagram illustrating a typical circuit which may be used to connect the power source to the electromagnet in response to the transformation of sound waves to electrical signals, including the pulse amplifier, one-shot circuit and power amplifier.

Figure 1:
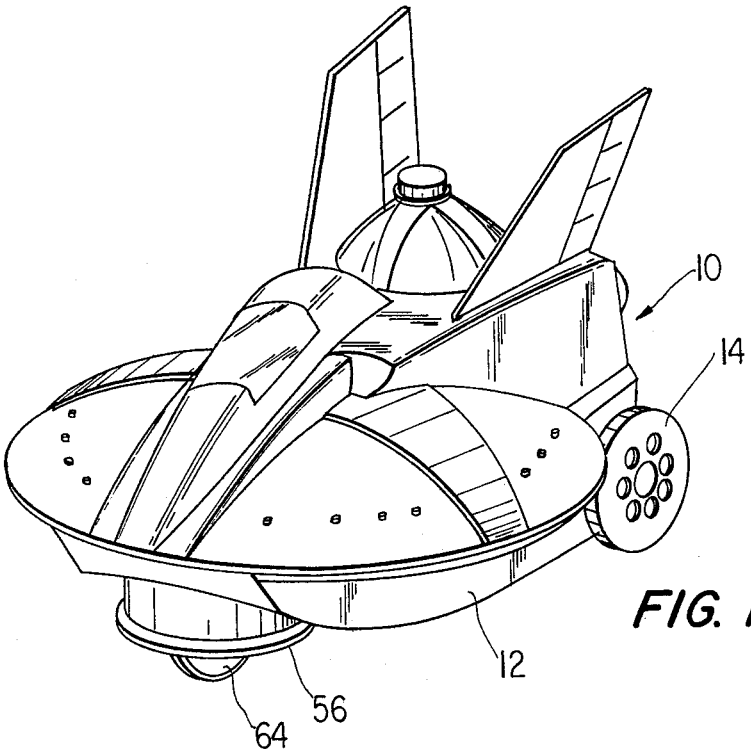
FIG. 1 is a perspective view of the sonic responsive toy vehicle illustrating the rear wheels which are freely mounted for rotation, the combination propulsion and guidance front wheel which is mounted for rotation and turning, and the handheld sound wave generating unit which may be conveniently stored in an opening provided in the chassis of the vehicle when not in use.
Figure 2:
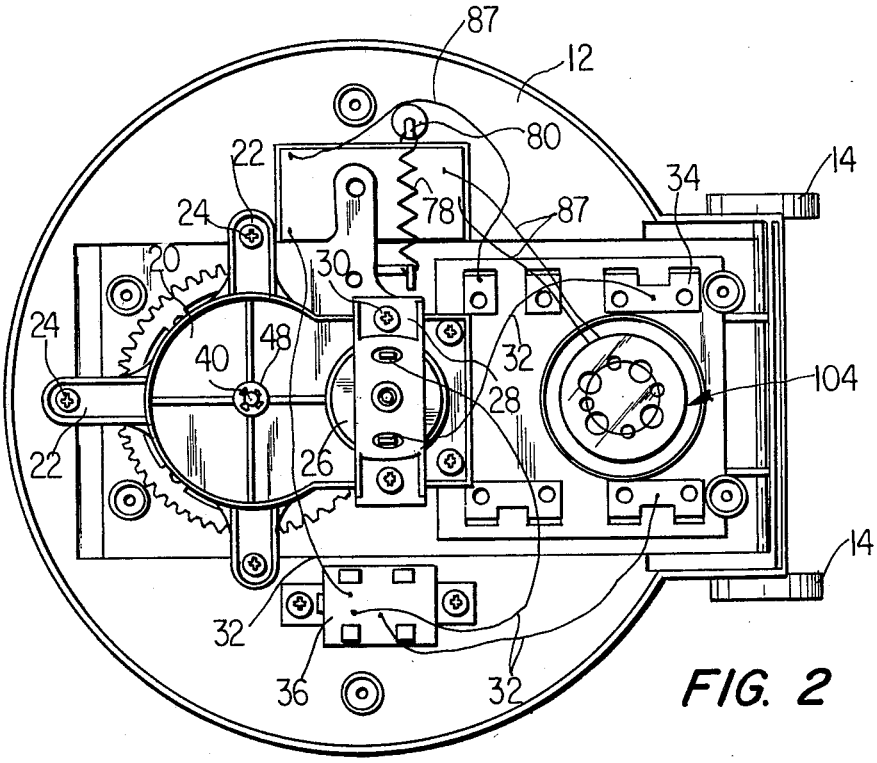
FIG. 2 is a top plan view of the toy vehicle with a part of the chassis removed so as to illustrate the rotatably mounted propulsion and steering wheel, the motor for driving same, the switch mechanism for energizing the motor and the sonic transducer which is responsible for translating the sound waves into proportional electrical signals to energize the electromagnet which permits the wheel to rotate to change the direction of travel of the vehicle.
Figure 3:
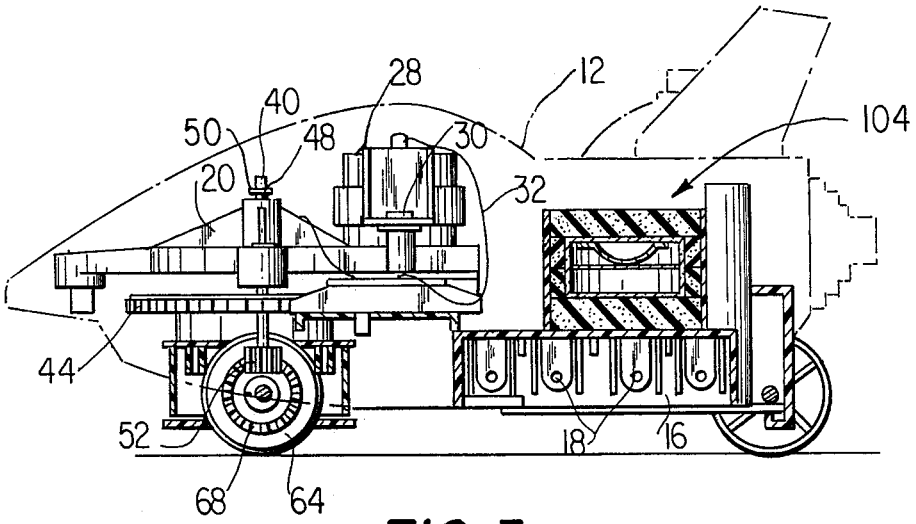
FIG. 3 is a side elevational view of the toy vehicle with a portion of the casing thereof removed so as to expose the internal mechanisms, including in particular the sonic transducer, batteries for operating the motor and electromagnet, and the housing and gearing mechanism for mounting and operating the propulsion and steering wheel.

DESCRIPTION OF THE PREFERRED EMBODIMENT:

The toy vehicle 10, as illustrated in FIGS. 1 and 2, is provided with a chassis 12 to which rear wheels 14 are freely mounted for rotation. A compartment 16 is provided within the bottom of the chassis 12, as illustrated in FIG. 3, within which a plurality of batteries 18 are located. A supporting plate 20 is provided with arms 22 which are secured to the chassis 12 with fasteners 24. The plate 20 is provided with an opening through which a miniature electrical motor 26 is positioned, and a bracket 28 is attached with fasteners 30 to the supporting plate 20 to suspend the motor 26 therefrom. Appropriate wiring 32, conductors 34 and a switch mechanism 36 are employed to operatively connect the batteries 18 to the motor 26, such that when the switch 36 is turned on the motor 26 is energized.

The power and steering wheel assembly 38, the details of which are illustrated in FIGS. 6–7, consists of a shaft 40 to which is fixedly secured a disc 42 which is provided along the periphery thereof with a rack of teeth 44, the shaft 40 terminating downwardly in a gear wheel 52. From FIG. 2, it will be apparent that the shaft 40 extends upwardly through an opening 48 provided in the plate 20, and a fastener 50 secured to the end of the shaft 40 thus mounts the disc 42 for rotation with respect to the supporting plate 20. Returning to FIGS. 6–7, the reference numeral 50 designates a housing which is provided with a centrally disposed opening 51 through which the shaft 40 extends. The housing is provided with posts 53 which are appropriately secured with fasteners within abutments 54 which extend upwardly from the disc 56. Extending downwardly from the housing 50 are flanges 58 and extending upwardly from the disc 56 are flanges 60. The flanges 58 are provided with openings therein such that in assembled position (FIG. 6) wherein the flanges 58 and 60 abut, the shaft 62 is appropriately journalled for rotation. The propulsion and steering wheel 64, around which a traction band 66 is mounted, is fixedly secured to the shaft 62, and a gear 68 formed as an integral part of the wheel 64 extends outwardly therefrom engaging the teeth of the gear 52. From the foregoing, it will be apparent that the housing 50 and disc 56 to which the propulsion-steering wheel 64 is mounted are free to rotate with respect to the shaft 40 and the disc 42, and the direction of the wheel 64 determines the direction of travel of the vehicle 10. It is also understood that as the switch 36 is turned on and the motor 26 is energized, the rotating gear wheel 46 secured to the shaft of the motor 26 meshes with the rack of teeth 44 rotating the disc 42. Rotation of the disc 42 causes the shaft 40 and the gear 52 attached to the disc 42 to rotate. The rotating gear 52 thus meshes with the gear 68 causing the propulsion-steering wheel 64 and the shaft 62 to rotate. There is a sufficient tolerance between the opening 51 of the housing 50 and the shaft 40 which passes through the opening 51 to permit the shaft 40 and the disc 42 attached thereto to freely rotate with respect to the housing 50 when the housing 50 is prevented from rotating in a manner described hereinafter, but the housing 50 and the propulsion-steering wheel 64 mounted thereto when not prevented from moving rotate with the shaft 40 and disc 42.

Figure 4:
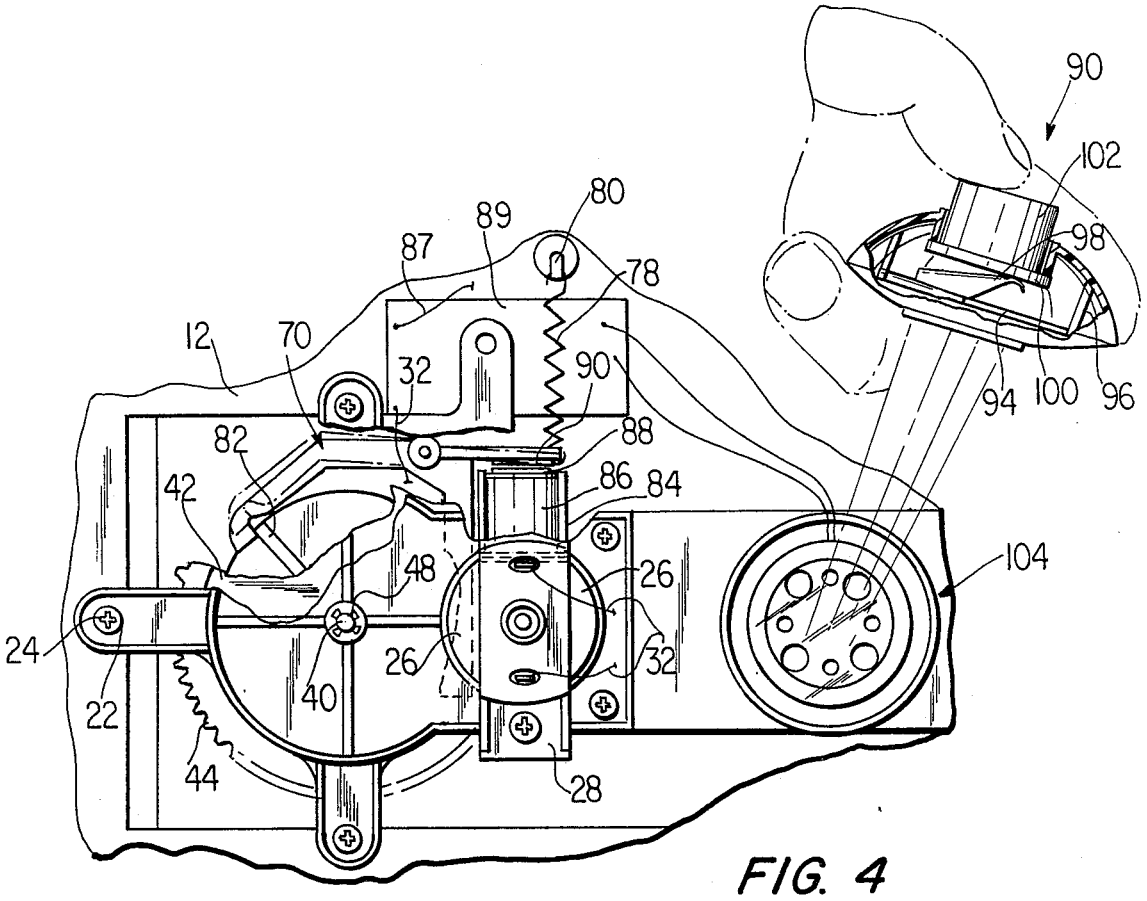
FIG. 4 is a top plan view of the rotatably mounted actuating member within the toy vehicle which is normally spring biased to a first position wherein a hook end thereof engages one of several spokes extending outwardly from the housing which amounts the propulsion-steering wheel to prevent the wheel from turning, and which is moved to a second position by interaction with an electromagnet actuated by the sonic transducer wherein the hook end is removed permitting the wheel to turn, and a side elevational view partly in section of the handheld sound wave generating unit.

As seen in FIGS. 4–5, an actuating mechanism 70 is mounted to rotate about a post 72 which is secured to the chassis 12, and is provided with an arm 74 terminating in a hook 76. The other end of the arm 74 is provided with a flange 77 to which one end of a spring 78 is secured, it being understood from FIG. 2 that the other end of the spring 78 is appropriately mounted to a post 80 provided on the chassis 12. Thus, the spring 80 normally urges the actuating member 70 to rotate about the post 72 in a clockwise direction, as illustrated in FIG. 5, wherein the hook 76 of the arm 74 is positioned within the path of travel of the four spokes 82 which, as illustrated in FIGS. 4 and 7, extend outwardly from the housing 50. The effect of the spring 78 is to urge the hook 76 inwardly towards the housing 50 such that the spokes 82 engage the hook 76 thus preventing the housing 50, to which the propulsion-steering wheel 64 is mounted, from rotating with the shaft 40 and the disc 42 attached thereto.

As illustrated in FIG. 4, there is mounted within a bracket 84 appropriately secured to the chassis 12 an electromagnet 86 of conventional construction suitably connected by wires 87 and a circuit board 89 to the batteries 18, as explained hereinafter. The effective face 88 of the electromagnet 86 is positioned in spaced relationship with respect to a metal plate 90 attached to the arm 74 of the actuating member 70 in such manner that when the electromagnet 86 is energized, the metal plate 90 is attracted towards the effective face 88 of the electromagnet 86 causing the actuating member 70 to rotate against the force of the spring 78 which results in the hook 76 which is located at the end of the arm 74 being withdrawn from engagement with the spokes 82 which extend outwardly from the housing 50 thus freeing the housing 50 and propulsion-steering wheel 64 to rotate with the continuously rotating shaft 40 and disc 42.

As also illustrated in FIG. 4, the reference numeral 90 designates a constant frequency handheld sound wave generating unit comprising a housing 92 within which is mounted a resilient metal plate 94, the ends of which are appropriately mounted to arms 96 of the housing 92. The plate 94 is provided with an upwardly extending actuating member 98 which normally engages the shoulder 100 of the fingerpiece 102. Thus, when the fingerpiece 102 is depressed against the force of the actuating member 98 the effect is to move both the actuating member 98 and the sound producing plate 94 downwardly producing a sharp "clicking" sound. As will be explained hereinafter, this sound is responsible for actuating the electromagnet 86 which in turn is responsible for withdrawing the hook 76 from engagement with the spokes 82 thus freeing the propulsion-steering wheel 64 for rotation.

As illustrated in FIGS. 2 and 3, there is provided within the top of the vehicle 10 a sonic transducer generally designated by the reference numeral 104, it being apparent that such transducers are well known in the art as disclosed in U.S. Pat. Nos. 3,439,128; 3,654,402; 3,472,972 and 3,749,854 and may comprise, for example, a crystal microphone compatible with the sound wave generating unit 90 which is capable of translating sound waves into proportional electrical signals. Since such microphone construction is well known in the art it will suffice to note that the microphone may comprise a housing provided with a sound wave emitting aperture and a diaphragm attached thereto. A bimorph, secured to the diaphragm, may consist of a pair of oppositely polarized ceramic wafers having electrodes on each of the faces of the wafers and an electrode connecting the inner faces of the wafers.

In FIG. 8 there is shown for illustrative purposes only a basic block diagram of the type of electrical energizing and timing circuit which may be used to intermittently energize the electromagnet 86 for removing the hook 76 from engagement with the spokes 82. The frequency of the output oscillations of the sound wave generating unit 90, hereinafter referred to as the pulser, is selected to be compatible with the sonic transducer generally illustrated at 104 as a crystal microphone which is frequency selected in response to the received sonic vibrations. The selectivity is not critical, it being sufficient that an output pulse from the pulser 92 is effective to produce a recognizable electrical pulse at the output of the transducer 104.

The output signal from transducer 104 is supplied to pulse amplifier 106 which suitably amplifies the electrical signal from the transducer 104 and provides a pulse of proper wave shape to a one-shot circuit 108. The one-shot circuit 108 then supplies a pulse of desired duration and amplitude to a power amplifier 110. The power amplifier 110 in turn energizes the winding 112 of the electromagnet 86 for a suitable time duration to operate the actuating member 70, previously described. With reference to FIG. 8, the input terminals 114 and 116 correspond to the input to the pulse amplifier 106. The pulse amplifier 106 includes the usual input coupling capacitor 118 and biasing and load resistors 120 and 122 for driving the input transistor Q1 of the pulse amplifier. Coupling capacitor 124 connects the output of transistor Q1 to the base of transistor Q2, the latter having its collector connected to the base of transistor Q3 of the one-shot circuit 108. An RC timing circuit comprising capacitor 126 and resistor 128 couple the output from the collector of transistor Q3 to the base of transistor Q2. Finally, resistor 130 couples the output of transistor Q3 of the one-shot circuit 108 to the base of transistor Q4 of the power amplifier 110. Transistor Q1 is normally non-conducting, with the result that the collector terminal thereof is at the positive source potential, rendering the transistor Q2 to normally conducting and, in turn, the transistor Q3 normally non-conducting. Transistor Q4 thereby is maintained in a normally non-conductive state. Solenoid winding 112 therefore is normally de-energized. The electrical signal generated in response to a received sonic pulse from the transducer 104 renders transistor Q1 of the input pulse amplifier 106 conductive, the negative going potential at the collector terminal thereof thereby rendering transistor Q2 to non-conductive. The collector of transistor Q2 thereupon is positive-going, turning on transistor Q3. Collector transistor Q3 thereupon becomes clamped to ground potential, rendering Q4 conductive and completing an energizing circuit from the positive power supply terminal 132 ($V_{cc}$) through the transistor Q4 and electromagnet winding 112 to ground potential terminal 134 thereby energizing the solenoid winding 112. The RC circuit of the one-shot circuit 106 determines the period of energization of the transistor Q3 in its feedback circuit configuration, thereby turning on transistor Q2 once again and turning off transistor Q3.

The collector of transistor Q3, no longer clamped to the ground potential, results in transistor Q4 being turned off thereby terminating energization of the solenoid winding 112.

With the foregoing in mind it will be apparent that as the switch 36 is turned on the motor 26 is energized causing the wheel 64 to rotate propelling the vehicle 10 along a surface. The rear wheels 14 serve only to stabilize the vehicle 10. The housing 50 to which the wheel 64 is mounted is prevented from turning by the engagement of the hook end 76 of the actuating mechanism 70 with one of the spokes 82. When the pulser 90 is operated the transducer 104 is activated energizing the electromagnet 86 which rotates the actuating mechanism removing the hook 76 from engagement with the spoke 82 thus freeing the housing 50 and the wheel 64 to turn which changes the direction of travel of the vehicle 10. The electromagnet 86 remains energized only for a short time, after which the actuating member 70 assumes its original position under the influence of the spring 78 at which time the hook 76 moves back into blocking engagement with one of the spokes 82 preventing the wheel 64 from turning until the pulser 90 is operated again. The duration of the energization of the electromagnet 86 is sufficient to permit the wheel 64 to turn a distance corresponding to the distance between adjacent of the spokes 82.

I claim:

1. A toy vehicle and remote control steering system, comprising a chassis, a single wheel for propelling and guiding said vehicle, means mounting said wheel for rotation about a first axis to propel the vehicle along a surface and for turning about a second axis to steer the vehicle along a surface, propulsion means within said chassis, means operatively connecting said wheel and said propulsion means to rotate said wheel to propel said vehicle, means for sensing sound waves and temporarily connecting said propulsion means and said wheel for turning said wheel to steer said vehicle, and means remote from said vehicle for generating said sound waves.

2. A toy vehicle and remote control system as in claim 1, wherein said means mounting said wheel for rotation and turning comprises a shaft along said second axis and provided with a gear at one end thereof, means mounting said shaft to said chassis for rotation along said second axis, a housing, means mounting said shaft and disc to rotate with respect to said housing along said first axis, and a gear provided on said wheel and meshing with said gear of said shaft such that the rotation of said shaft causes said wheel to rotate.

3. A toy vehicle and remote control steering system as in claim 2, wherein said means operatively connecting said wheel and said propulsion means comprises a gear connected to said propulsion means, a disc mounted on said shaft, a continuous rack of teeth formed along said disc and engaged by said gear of said propulsion means such that the rotation of said gear of said propulsion means causes said disc and shaft to rotate.

4. A toy vehicle and remote control steering system as in claim 3, wherein said means for temporarily connecting said propulsion means to said wheel for turning said wheel comprises an electromagnet, an actuating member, means mounting said actuating member to pivot, means normally biasing one end of said actuating member into engagement with said housing to prevent said housing from rotating, and means on said actuating member attracted by said electromagnet during energization of said electromagnet for moving said actuating member to remove said end thereof from engagement with said housing to permit said housing and said wheel mounted therein to rotate with said shaft and disc.

5. A toy vehicle and remote control system as in claim 4, wherein said means remote from said vehicle for generating sound waves comprises a handheld constant frequency sound wave generator, and wherein said means for sensing sound waves comprises a sonic transducer compatible with said handheld generator.

6. A toy vehicle and remote control steering system as in claim 1, further comprising additional wheels, and means mounting said wheels to said chassis for rotation.

7. A toy vehicle and remote control steering system, comprising:

a shaft mounted to said vehicle for rotation and having a gear, a housing mounted to rotate with respect to said vehicle, said shaft being mounted to rotate with respect to said housing, a single wheel for both propelling and guiding said vehicle, said wheel being mounted to rotate with respect to said housing and having a gear meshing with said gear of said shaft such that the rotation of said shaft causes said wheel to rotate;

propulsion means operatively connected to said shaft to rotate said shaft and said wheel to propel said vehicle;

and electromagnet, and means for sensing sound waves for energizing same;

an actuating member mounted for movement and normally preventing said housing from rotating, said actuating member being provided with means attracted by said electromagnet for releasing said housing during the energization of said electromagnet to permit said housing and said wheel to temporarily rotate to steer said vehicle; and means remote from said vehicle for generating said sound waves.

8. A toy vehicle and remote control steering system as in claim 7, wherein said means remote from said vehicle for generating sound waves comprises a handheld constant frequency sound wave generator, and wherein said means for sensing sound waves for energizing said electromagnet comprises a sonic transducer compatible with said hand-held generator.

9. A toy vehicle and remote control steering system as in claim 7, further comprising additional wheels mounted to said vehicle for rotation to stabilize said vehicle.

* * * * *